United States Patent [19]

Hunter

[11] 4,186,521

[45] Feb. 5, 1980

[54] SAFETY GATE FOR VEHICLE WHEEL ALIGNMENT PIT INSTALLATIONS

[76] Inventor: Lee Hunter, 13501 Ladue Rd., Ladue, Mo. 63141

[21] Appl. No.: 911,762

[22] Filed: Jun. 2, 1978

[51] Int. Cl.[2] ..... E05F 15/20; E05F 17/00

[52] U.S. Cl. ..... 49/30; 49/107; 49/115; 49/118; 49/280; 49/334; 49/366

[58] Field of Search ..... 49/30, 32, 73, 107, 49/115, 116, 118, 334, 280, 366; 160/40, 117

[56] References Cited

U.S. PATENT DOCUMENTS

| | | | |
|---|---|---|---|
| 1,519,749 | 12/1924 | Ainsworth | 49/118 X |
| 2,003,533 | 6/1935 | Green | 49/30 X |
| 2,091,065 | 8/1937 | Buettner | 160/117 X |
| 2,101,147 | 12/1937 | Lux | 160/40 |
| 2,455,018 | 11/1948 | McKeown | 49/366 X |
| 2,561,623 | 7/1951 | Hall | 49/334 |
| 3,370,381 | 2/1968 | Wetter | 49/107 |
| 3,429,073 | 2/1969 | Tucker,Jr | 49/30X |
| 3,940,887 | 3/1976 | Slaybaugh | 49/334 X |
| 4,121,382 | 10/1978 | Dietrich et al. | 49/334 |

FOREIGN PATENT DOCUMENTS

| | | | |
|---|---|---|---|
| 836429 | 6/1960 | United Kingdom | 49/115 |

*Primary Examiner*—Philip C. Kannan
*Attorney, Agent, or Firm*—Gravely, Lieder & Woodruff

[57] ABSTRACT

Safety gate mechanism for use in protecting persons working around automobile service equipment installed in a floor pit comprising bi-parting gate sections mounted for movement between closed positions in front of the floor pit and open positions along side the floor pit, circuit means for automatically opening the gate sections once a signal is generated that a vehicle is to be placed in the floor pit area for service, and means in the circuit for locking and unlocking the gate sections and for reclosing the open gate sections in a desired time period should a vehicle fail to move into the floor pit area or after a vehicle has been removed from the floor pit area.

6 Claims, 9 Drawing Figures

FIG. 1
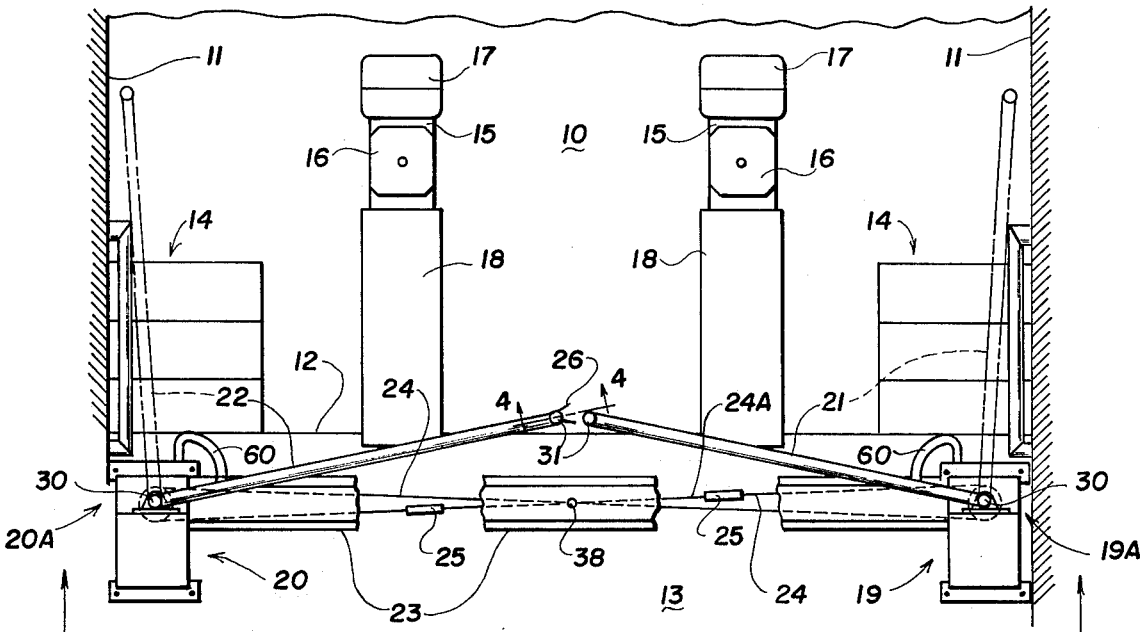
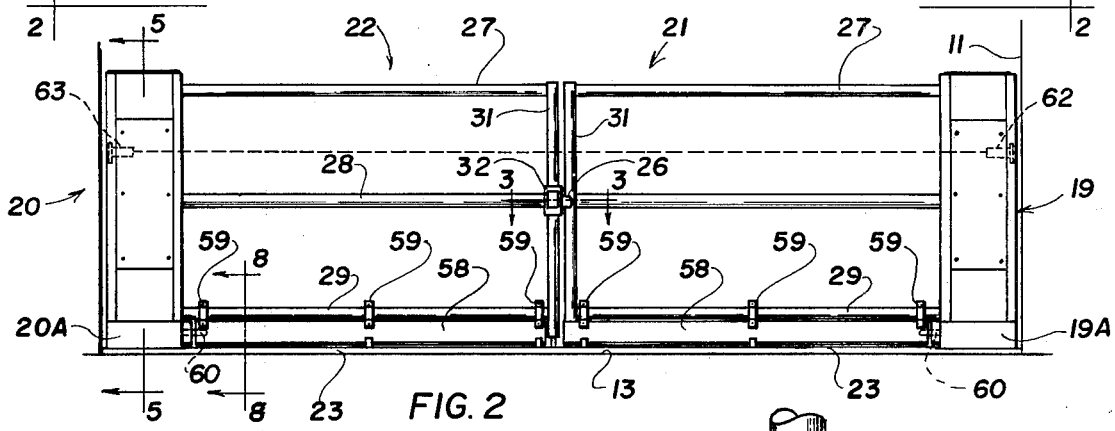
FIG. 2
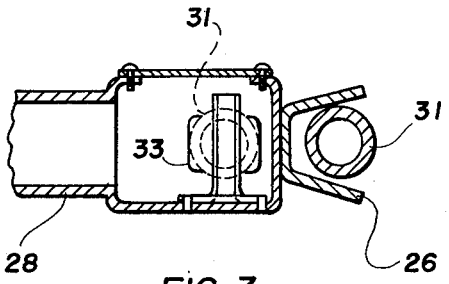
FIG. 3
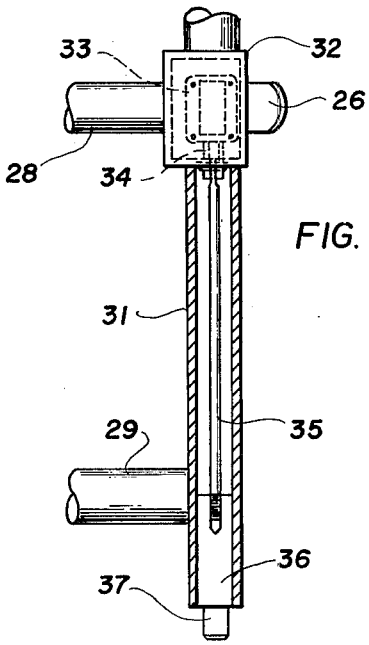
FIG. 4

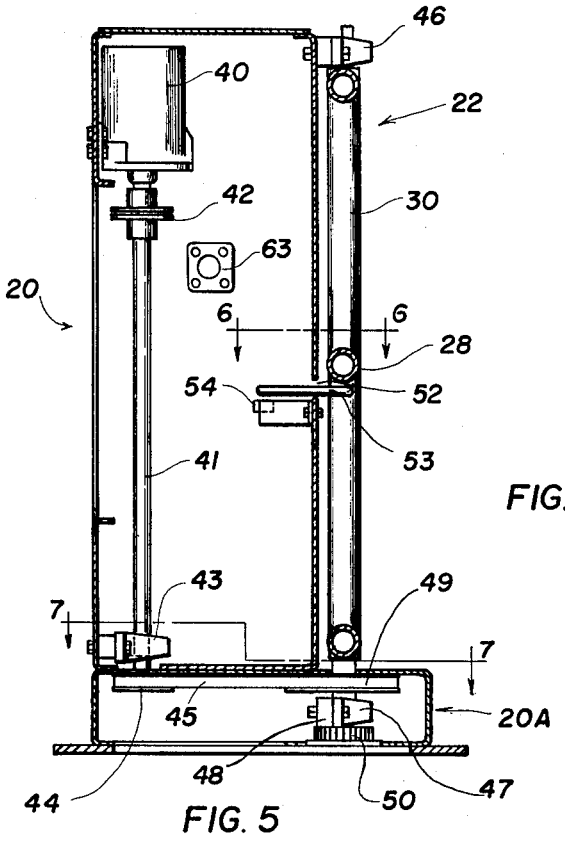
FIG. 5
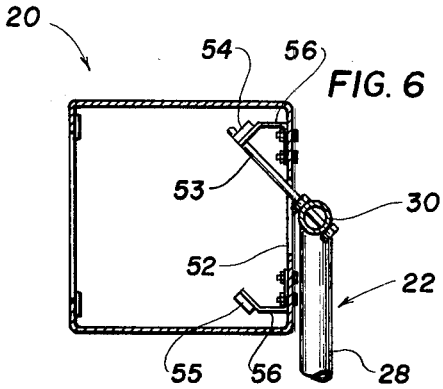
FIG. 6
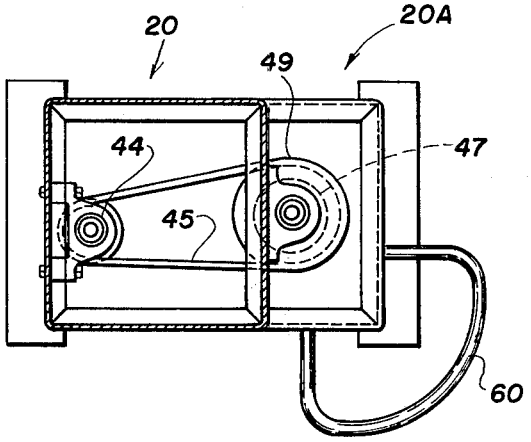
FIG. 7
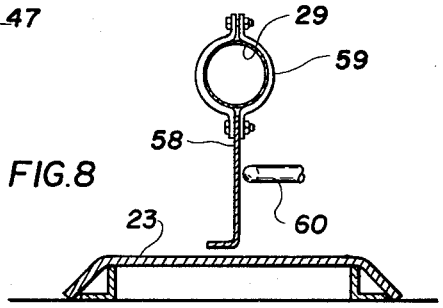
FIG. 8
FIG. 9
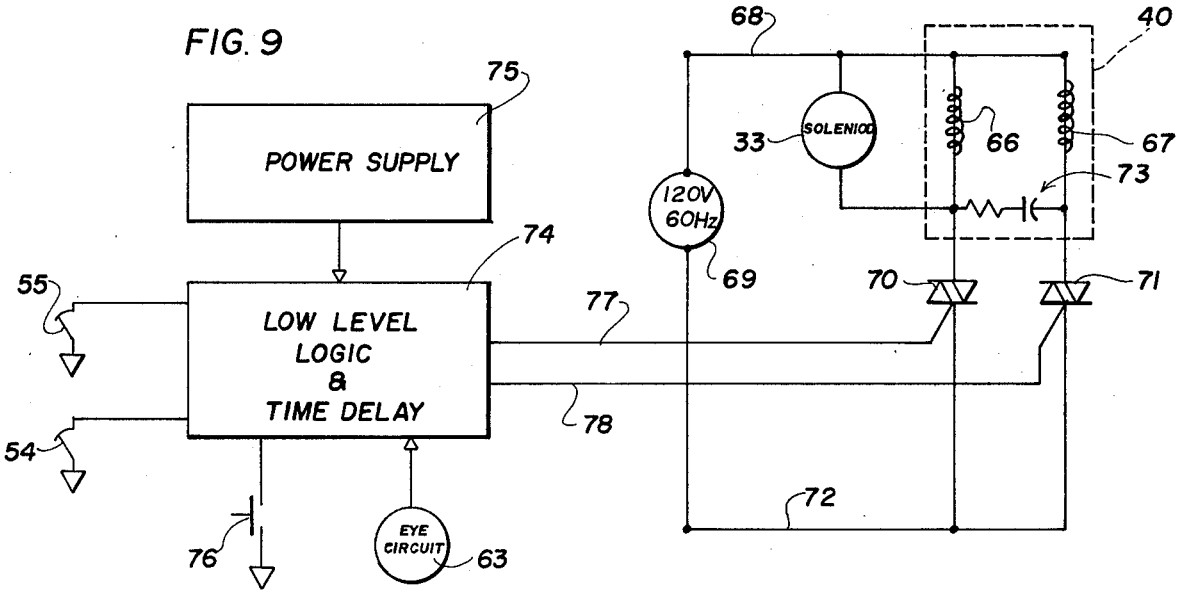

SAFETY GATE FOR VEHICLE WHEEL ALIGNMENT PIT INSTALLATIONS

BACKGROUND OF THE INVENTION

The protection afforded open pit areas in vehicle service shops has heretofore been generally non-existant. In a few instances protective devices have been manually set up to block access to a pit to prevent shop personnel as well as customers and others from falling into the pit or onto vehicle alignment apparatus situated in the pit. More certain protective means is sometimes employed and consists of removable fence sections having posts which drop into floor sockets to support the fences. In the latter cases, the fense sections are heavy and must be manually placed in position if the floor sockets are clear of debris so the posts may freely enter the sockets. Whatever the protective means provided, it is either inadequate, cumbersome to handle, not really capable of affording satisfactory protection, and not uniform in make-up.

BRIEF DESCRIPTION OF THE PREFERRED EMBODIMENT

This invention relates to safety gate means for pit installed vehicle wheel alignment apparatus.

The objects of this invention are: to provide a safety gate assembly that is permanently in operative position, to provide a gate system that will operate to open on command, stay open as long as a vehicle is in the pit area, and close promptly after a vehicle has withdrawn from the pit area; and to provide a safety gate assembly that will satisfy regulations concerning preventing people accidentally falling into the pit area as well as preventing tools and other objects from being accidentally kicked into the pit area whereby to guard workers in the pit area from being injured by such objects.

A preferred embodiment of this invention comprises spaced supports or towers which pivotally support bi-parting gate sections, operating means in at least one of the towers for swinging the gates between closed and open positions, means interconnecting the gate sections so they move in unison, safety barrier means carried by the gate sections and operated upon gate movement between extended and retracted positions, and an operating system for affecting the opening and closing of the gate sections.

BRIEF DESCRIPTION OF THE DRAWINGS

The presently preferred embodiment of this invention is shown in the several views of the accompanying drawings, wherein:

FIG. 1 is a general plan view of a portion of a shop service area formed with a pit in which vehicle wheel alignment equipment is disposed, and a pit safety gate assembly shown in partly closed position and in broken line open position;

FIG. 2 is an elevation view of the gate assembly as seen from an approaching vehicle;

FIG. 3 is a fragmentary sectional view of the gate keeper means seen along line 3—3 in FIG. 2;

FIG. 4 is a fragmentary sectional view of the gate locking means as seen along line 4—4 in FIG. 1;

FIG. 5 is a sectional elevational view of the left tower which houses the gate drive assembly and control means, the view being taken along line 5—5 in FIG. 2;

FIG. 6 is a fragmentary detail of the gate position responsive switch means seen along line 6—6 in FIG. 5;

FIG. 7 is a fragmentary detail of a typical gate drive means seen along line 7—7 in FIG. 5;

FIG. 8 is a fragmentary sectional view of the safety barrier or toe plate and lift cam seen along line 8—8 in FIG. 2; and FIG. 9 is a diagram of the circuit layout for the safety gate assembly.

DETAILED DESCRIPTION OF THE PREFERRED EMBODIMENT

FIG. 1 is a plan view of a pit area 10 having spaced side walls 11, a front wall 12 and a floor area 13 accommodating the vehicle approach to the pit. The access into the pit area 10 is accommodated by steps 14 at each side wall 11. The pit area is occupied by pedestals 15 which carry turn plates 16. Beyond these turn plates stop chocks 17 are located to prevent wheel run-off. Removable runways 18 bridge the distance from the pit front wall 12 to each pedestal 15. What has been described is conventional.

The pit area 10 is protected (FIGS. 1 and 2) by a safety gate installation which guards the front drop-off wall 12 of the pit from the approach 13 to the pit. The installation comprises a pair of towers 19 and 20 which pivotally support gate sections 21 and 22 respectively. An arched sill plate 23 (made up of at least two pieces) extends between the towers to cover and protect gate motion coordination means which includes cables 24 and 24A, and turn-buckles 25 in cable 24A, the operation of which will be described presently. The gate sections 21 and 22 swing from closed positions (FIG. 2) to open positions in broken line (FIG. 1), and when in the closed position they are interconnected by a keeper 26 (FIG. 3). Each gate section is made up of horizontal rails 27, 28 and 29 which are connected to pivot posts 30 at each tower and to center posts 31. The left center post 31 carries the keeper 26 in position to mesh with the right center post 31 (FIG. 3) when the gate sections are closed.

In addition to the keeper 26, the left center post 31 carries a retractable locking means (FIG. 4) comprising a housing 32 for a solenoid 33 wired to the control center through the gate rail 28 in the usual manner. The circuit can be seen in FIG. 9. The solenoid armature 34 is connected to the upper end of an actuating rod 35 which extends through the vertical center post 31 to engage a slide block 36 within the bottom of the center post. The block 36 has a lock pin 37 on its lower end. In the normally unenergized condition of the solenoid, the weight of the block 36 and rod 35 will project the lock pin 37 into a suitable aperture 38 (see FIG. 1) formed in the sill plate 23. When energized, the solenoid 33 will pull the block 36 upwardly in the center post 31 and lift the lock pin out of the aperture 38 so the gate sections 21 and 22 may be swung open. The opening motion disconnects the keeper 26.

The left tower 20 of the gate assembly carries a reversible gate actuating motor 40 (FIG. 5) of low RPM, of the order of about 6 RPM in either direction. The motor drives shaft 41 through a suitable coupling 42, and the lower end portion of shaft 41 is supported in a bearing 43 located above the pulley 44 which is keyed to the shaft 41 to drive a transmission belt 45. The gate section 22 has its vertical pivot post 30 operably mounted in an upper bearing 46 near the top of tower 20, and the lower end of the shaft enters the base housing 20A and is supported by a second bearing 47 attached to a support 48 which spans the side walls of the base housing 20A. A pulley 49 is attached to shaft 30 above the bearing 47 and a gear 50 is attached to shaft 30 below the bearing 47. The gear 50 is in line with the arched sill plates 23 which extend between the towers.

The right hand tower 19 has a base housing 19A which encloses the lower end of the pivot post 30 (not shown) for the gate section 21 is exactly the same manner shown in FIG. 5, and a duplicate gear (not shown) like gear 50 is provided. Each gear 50 is engaged by a suitable length of sprocket chain which has its opposite ends connected to the cables 24 and 24A. The cables 24 and 24A are adjusted for tension by turnbuckles 25 so that the gears will simultaneously swing the gate sections 21 and 22 between closed and open positions. The cables and turnbuckles are protected by the arched sill plates 23 for free movement. The upper end of the pivot post 30 is mounted in a bearing which is a duplicate of the upper bearing 46 on the left hand tower 20.

In FIGS. 5 and 7, the drive means between the motor 40 and the gate sections includes the drive pulley 44 and the driven pulley 49, the latter being on the same shaft with gear 50. The ratio between the pulleys may be about 9 to 1. For example, the drive pulley 44 may have a two inch pitch diameter and the driven pulley 49 may have an eighteen inch pitch diameter. The gear 50 will then rotate with the driven pulley 49 at the low speed thereof. The drive motor 40 is a reversible type that operates at the very low speed of about 6 RPM.

In FIGS. 5 and 6, the left tower 20 is seen formed with a slot 52 directed generally horizontally so as to form an opening for a gate motion follower rod 53 carried by the pivot post 30 near the middle rail 28 of gate section 22. The follower rod 53 extends into the housing 20 and moves between limit switches 54 and 55. Each such switch is mounted on a suitable support 56 which allows for adjustment of the location of the switches to obtain the desired end limits of gate motion, which motion may be somewhat greater than 90 degress of arc. It is only necessary to provide a single follower rod 53 in view of the arrangement of the cables 24, 24A and turnbuckles 25 for effecting movement of the gate sections 21 and 22 in unison, but in opposite directions of swing.

Turning now to FIGS. 1, 2, 7 and 8 it can be seen that the bottom rails 29 of the respective gate sections 21 and 22 support barriers or toe plates 58 by means of clamps 59 which are loose on the rails 29 to allow the toe plates to pivot relative to the rails 29 when the gate sections swing toward open positions. The base housings 19A and 20A of the respective towers 19 and 20 are provided with essentially the same shaped cam bar 60 (best seen in FIG. 7). The bars 60 are positioned to be engaged by the toe plates pivot by the clamps 59 on the bottom rails 29. It is understood that as these rails swing around toward open, cam bars 60 will lift the tow plates so they will clear any of the means mounted in the pit, and remain pivoted out of the way while the gate sections are in open position.

FIG. 2 shows in broken line an electric eye sensor in which the light source 62 may be mounted in the tower 19 to direct its beam toward the receiver means 63 mounted in the tower 20. These units 62 and 63 are disposed at a desired vertical spacing from the approach area 13 so the beam can be broken by a vechicle moved onto the ramps 18. Suitable apertures are formed in the towers to accommodate the beam, and are located in advance of the position of the gate sections 21 and 22 when closed. The action of the receiver means 63 is well understood to generate a signal when the light beam from the source 62 is broken.

A suitable circuit for establishing the various functions of the safety gate is seen in FIG. 9. The reversible motor 40 which swings the gate sections 21 and 22 is provided with windings 66 and 67 connected to the hot line 68 which isconnected to available 120V, 60Hz power source 69. These windings are connected through thyristor switching devices 70 and 71 to the ground line 72 or other side of the power source 69. Also, the power circuit includes the solenoid 33 which is parallel with the motor circuit.

The electromechanical components are completely controlled by two thyristors 70 and 71 which behave like switches for the AC line voltage. To open the gates, thyristor 70 must be turned on. This closes the circuit for motor winding 66 directly and motor winding 67 phase shifted by a capacitor 73. To close the gates, a second thyristor 71 must be turned on. This closes the circuit for motor winding 67 directly and motor winding 66 phase shifted by the capacitor 73. In either case the solenoid 33 for the lock pin 37 (see FIG. 4) is energized, thus pulling the locking pin 37 to the up position.

All of the electronics to make gate open and close decisions are implemented with conventional TTL (transistor-transistor logic) logic circuitry seen in block diagram at 74. The presence or absence of a vehicle between the towers 19 and 20 (or any object) is sensed by a photoelectric eye (industrial control type) located in the gate towers, and includes the light source 62 and receiver 63.

When the open button 76, contained in a pendant, is activated by the opertor, the logic circuit 74 is energized to turn on the open thyristor 70. When the open limit switch 55 is reached, the thyristor 70 is turned off and a timer (not shown) disposed in logic circuit 74 is then automatically activated. If the light beam from the souce 62 is not blocked within the present time limit (1 to 10 seconds), the thyristor 71 will be turned on to close the gates 21 and 22. Upon the close limit switch 54 being activated, thyristor 71 will be turned off and the timer will automatically function to try and close the gates. If however, the light beam remains blocked (presumably by a vehicle) before the end of the time limit, the gates will remain open. When the beam is later unblocked (the vehicle backing of the pit), the timer will be again automatically activated. If at the end of the time limit the light is still unblocked, the gates close as described above. Whenever the gates are in a closing cycle, and the light is blocked that will cause an immediate reversal to open the gates. It is understood when power is initially applied to logic circuits 74, the thyristers will turn on in random states. This is not desirable in the gate system. For example, a car could be in the pit when power is turned on and the gates might start closing. A power-on reset circuit in the logic will sense the power supply voltage and condition the electronics to prevent these problems.

While the foregoing description relates to a preferred arrangement, it is understood that variations may be made with the idea of accomplishing the same or substantially the same end result of defining the approach to the pit by spaced supports or towers which operably support gates movable between positions blocking access to the pit and positions unblocking the pit for vehicle access to the pit.

What is claimed is:

1. Safety gate means at the floor level for blocking access of a vehicle or person to the edge of a vehicle service floor pit, said gate means comprising: biparting gate sections; a pair of towers positioned spaced apart from each other but adjacent the edge of the floor pit, a gate section being pivotally supported by each tower for movement between aligned positions blocking access to the edge of the floor pit and separated positions projecting away from each edge in a direction to the suspended over the floor pit for exposing the edge of the floor pit between said towers; gate sections supporting posts pivotally mounted in each tower; drive means connected to each post; reversible power operated means in one of said towers operably connected to the gate supporting post therein; driven means extending between said towers and interconnecting said drive means for said posts, said driven means being adjacent the floor level and traversing the space between said towers for effecting simultaneous movement of said gate sections between said aligned and separated positions; and control means in said one of said towers connected to said power operated means, said control means including means for determining the direction of movement of said gate sections by operation of said reversible power operated means, gate section position limit switches in one of said towers responsive to the position of the adjacent gate section to determine the full aligned and separated positions of both of said gate sections, and manual switch means to initiate the operation of said control means.

2. The safety gate means of claim 1, wherein said control means includes photosensitive means adjacent said pair of towers for interruption in response to the presence of a vehicle or person in the approach to the floor pit edge to operate said power operated means in a direction to move said gate sections into the separated positions, the continued interruption of said photosensitive means maintaining said gate sections in the separated positions.

3. The safety gate means of claim 1, wherein said gate sections carry cooperative means for releasibly securing them in said aligned positions blocking access to the floor pit edge, and means connects said securing means to said control means for initiating release thereof upon operation of said manual switch means.

4. The safety gate means of claim 1, wherein each of said towers carries fixed cam means, and each gate section carries pivotally mounted barrier means adjacent the floor level at the edge of the floor pit, said barrier means normally assuming pendent positions for intercepting objects passable into the floor pit under said gate sections and being in positions to engage said fixed cam means and pivot into elevated positions concurrently with gate section movement toward said separated positions.

5. The safety gate means of claim 1, wherein plate means extends between said towers in position to protectively cover said driven means traversing the space between said towers, locking pin means carried by one of said gate sections in position to engage said plate means for retaining said one of said gate sections in aligned position, and keeper means carried by the other of said gate sections in position when in said aligned positions to engage said one gate section.

6. The safety gate means of claim 5, wherein said locking pin means in weighted so as to be responsive to gravity to move into gate section locking position, and electrically operated means is connected to said locking pin means and to said controlled means for releasing said locking pin means from said sill plate upon operation of said manual switch means.

* * * * *

UNITED STATES PATENT AND TRADEMARK OFFICE

CERTIFICATE OF CORRECTION

PATENT NO. : 4,186,521

DATED : February 5, 1980

INVENTOR(S) : Lee Hunter

It is certified that error appears in the above-identified patent and that said Letters Patent are hereby corrected as shown below:

Col. 3, Line 9: After the figure "21" and before the word "exactly", the word "is" should be changed to read "in".

Col. 4, Line 35: After "the" (first occurrence) and before the comma (,), the word "opertor" should be changed to read "operator".

Col. 4, Line 40: The first word before the figure "62" "souce" should be changed to read "source".

Col. 4, Line 40: After the word "the" and before the word "time", the word "present" should be changed to read "preset".

Col. 5, Line 10: The last word after the word "to", "the" should be changed to read "be".

Col. 5, Line 12: After the word "gate" and before the word "support-", the word "sections" should be changed to read "section".

Signed and Sealed this

*Twentieth* Day of *May 1980*

[SEAL]

*Attest:*

SIDNEY A. DIAMOND

*Attesting Officer*

*Commissioner of Patents and Trademarks*